US008161665B2

(12) United States Patent
Nakano

(10) Patent No.: US 8,161,665 B2
(45) Date of Patent: Apr. 24, 2012

(54) IMPACT ABSORBING MATERIAL

(75) Inventor: Kiyotaka Nakano, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 879 days.

(21) Appl. No.: 12/173,183

(22) Filed: Jul. 15, 2008

(65) Prior Publication Data

US 2010/0011620 A1 Jan. 21, 2010

(51) Int. Cl.
*A43B 23/07* (2006.01)
*A43B 19/00* (2006.01)
*A43B 13/22* (2006.01)

(52) U.S. Cl. ..... 36/55; 36/71; 36/72 R

(58) Field of Classification Search ..... 36/89, 96, 36/10, 55, 71, 72 R, 45
See application file for complete search history.

(56) References Cited

U.S. PATENT DOCUMENTS 2,869,253 A * 1/1959 Sachs ..... 36/3 A
5,528,841 A * 6/1996 Pozzobon ..... 36/3 A
5,915,819 A * 6/1999 Gooding ..... 36/29
6,012,236 A * 1/2000 Pozzobon ..... 36/55
6,381,876 B2 * 5/2002 Krajcir ..... 36/72 R
6,497,057 B1 12/2002 Lee et al.
7,134,223 B2 * 11/2006 Ganon ..... 36/12
2002/0017038 A1 * 2/2002 Umezawa ..... 36/31
2003/0097768 A1 * 5/2003 Baek ..... 36/55

FOREIGN PATENT DOCUMENTS

JP 2006042869 A * 2/2006
WO 2006017651 2/2006

* cited by examiner

*Primary Examiner* — Jila Mohandesi
*Assistant Examiner* — Melissa Lalli
(74) *Attorney, Agent, or Firm* — Warner Norcross & Judd LLP

(57) ABSTRACT

An impact absorbing material for a footwear article includes a first sheet having a plurality of projections for dispersing the force of an impact and a second sheet, having a lower durometer than the first sheet, that is bonded to the first sheet for absorbing the force from the projections. The projections are arranged on the first sheet such that nonlinear gaps are formed between adjacent pairs of projections. The impact absorbing material may be positioned between an upper and an inner liner of the footwear article and may be selectively positioned on the footwear article to protect an area on the wearer that is vulnerable to impact, such as the wearer's feet, ankles, heels or calves.

7 Claims, 4 Drawing Sheets

IMPACT ABSORBING MATERIAL

BACKGROUND OF THE INVENTION

The present invention relates generally to footwear, and more particularly to protective material for footwear.

In a variety of activities, the primary function of footwear is to protect and support the wearer's foot. Much of the support and protection afforded by footwear is attributable to the design and configuration of both the sole and the upper. The sole functions to protect the foot by dispersing the forces caused by running, jumping, walking and the like, while the upper functions to protect the foot, and in some cases, the ankle and calf, from external impact forces, such as when an object strikes the foot. For example, such impact may occur in an industrial or factory workplace setting or even in an outdoor setting, such as during hiking, hunting and the like.

The objectives of providing comfort and providing adequate protection often compete with one another. A soft, flexible upper designed for a comfortable fit may not provide adequate protection against impact forces. On the other hand, an upper formed from a hard, overly rigid material designed to efficiently protect the foot from impact forces may feel extremely uncomfortable and may result in blisters on the wearer's feet. Additionally, a hard upper material may not adequately absorb the force of an impact, such that a significant portion of the force may still be transferred to the wearer's foot.

SUMMARY OF THE INVENTION

The various embodiments of the present invention provide an impact absorbing material for an article of footwear that protects a wearer's foot, ankle and/or calf from impact forces, while providing a comfortable fit.

In one embodiment, the impact absorbing material includes a first sheet having a plurality of projections extending from the top surface of the sheet for dispersing the force of an impact. A second sheet, having a lower durometer than the first sheet, is bonded to the bottom surface of the first sheet for absorbing the force from the projections. The impact absorbing material is selectively attached to the footwear article in areas that are vulnerable to impact.

The projections may be vertically and/or horizontally offset, such that nonlinear gaps are formed between adjacent projections. Each of the projections may be hexagonal in shape and may include an indentation on its outer surface.

Optionally, the first sheet may have a durometer in the range of 80 to 85 on the Asker Type A scale, while the second sheet may have a durometer in the range of 50 to 55 on the Asker Type A scale. The first and second sheets may be bonded by compression molding and may be formed from rubber.

The impact material can be selectively positioned in a footwear article between an upper and an inner liner, and may optionally be included in the medial, lateral and heel portions of the upper.

According to another aspect of the invention, a footwear article includes an upper, a liner, an outsole, and a layer of impact absorbing material selectively positioned between the upper and the liner. The impact absorbing material includes a first sheet having a plurality of projections adapted to disperse force from an impact, and a second sheet bonded to the first sheet for absorbing the force from the projections. The second sheet has a lower durometer than the first sheet. Each of the projections on the first sheet is offset from projections immediately adjacent thereto, such that nonlinear gaps are defined between adjacent projections.

According to another aspect of the invention, a method of manufacturing an impact absorbing material for a footwear article includes providing a first sheet that includes a plurality of projections extending from a top surface of the sheet, with each of the projections being offset from immediately adjacent projections. A second sheet, having a lower durometer than the first sheet, is compression molded to the bottom surface of the first sheet to form the impact absorbing material. The impact absorbing material is selectively attached to the footwear article in at least one area that is vulnerable to an impact.

Thus, the impact absorbing material of the present invention includes a first sheet that is rigid enough to protect the wearer's foot from the force of an impact and a second sheet that is soft enough to absorb the impact and provide a comfortable fit. The projections on the first sheet are configured to disperse the force from an impact, to lessen the effect of the impact on one specific area of the foot and to create a dispersed force that is more easily absorbed by the softer second sheet. The combination of the first and second sheets provides an impact material that is lightweight yet has structural integrity.

These and other objects, advantages and features of the invention will be more readily understood and appreciated by reference to the detailed description of the invention and the drawings.

DETAILED DESCRIPTION OF THE CURRENT EMBODIMENT

Figure 2:
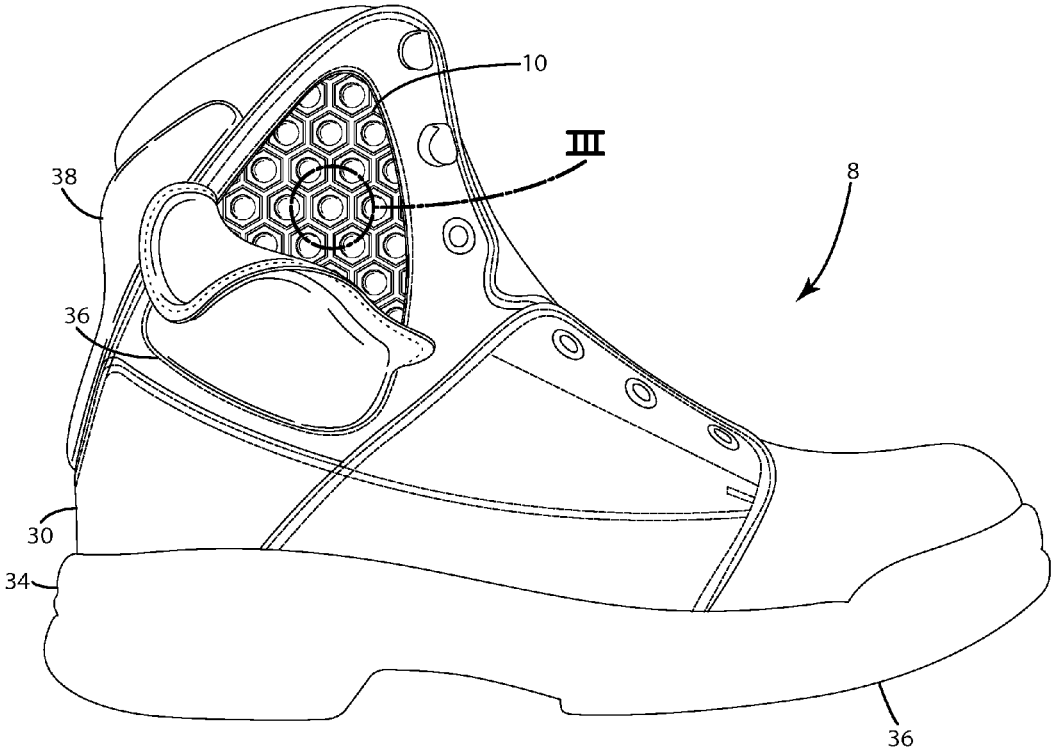
FIG. 2 is a side view of the boot with the impact absorbing material exposed.
Figure 4:
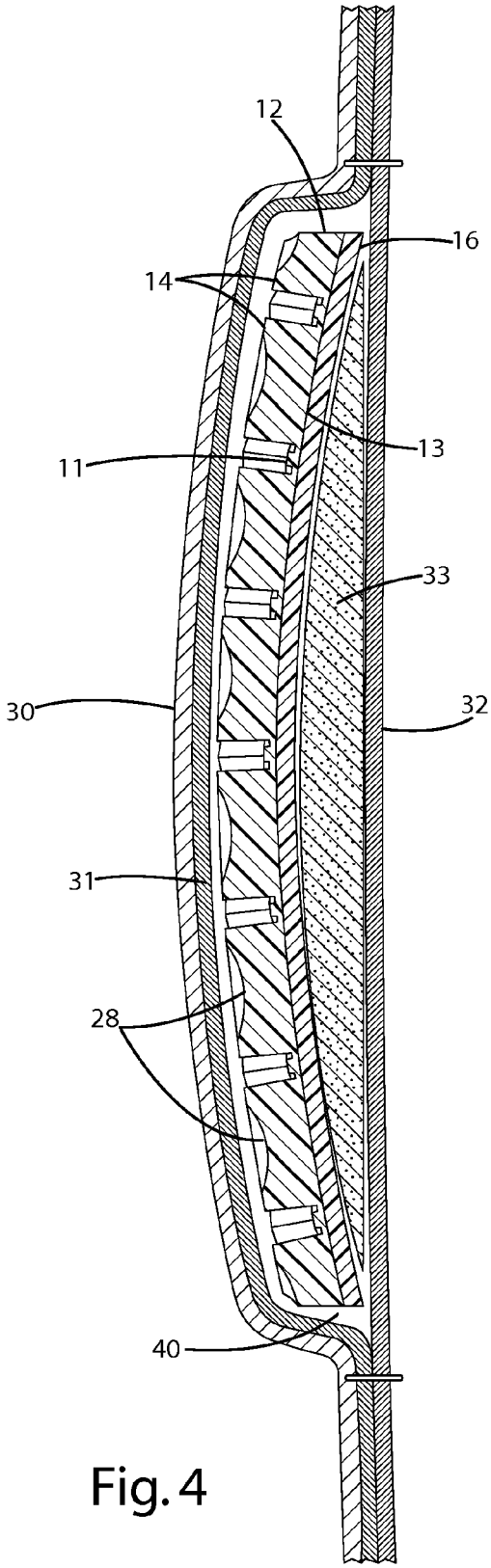
FIG. 4 is a sectional view of the boot taken along lines 4-4.

An impact absorbing material is shown in FIG. 2 in a footwear article or boot 8 and is generally designated 10. As shown in FIG. 4, the impact absorbing material 10 includes a first sheet 12 having a top surface 11 and a bottom surface 13, with a plurality of projections 14 extending from the top surface 13 for dispersing the force of an impact. A second sheet 16, having a lower durometer than the first sheet 12, is bonded to the bottom surface 13 of the first sheet 12 for absorbing the force from the projections.

The projections 14 of the first sheet 12 function to disperse or distribute the force of an external impact, such as that from an object striking the wearer's foot or ankle. Upon the transfer of the impact force to a portion or section of the projection 14, the force is diffused across the projection. The force from the projections 14 is then absorbed by the second sheet 12. In effect, the resulting forces transferred to the foot, ankle or calf through the impact absorbing material are only a portion of the initial impact force, which reduces the overall shock and impact to the wearer.

In the illustrated embodiment, the projections 14 are hexagonal, which may allow the projections to more easily disperse forces from impacts from various angles. However, the projections 14 may be any shape capable of adequately dispersing impact forces, for example, circular, octagonal or the like.

Figure 5:
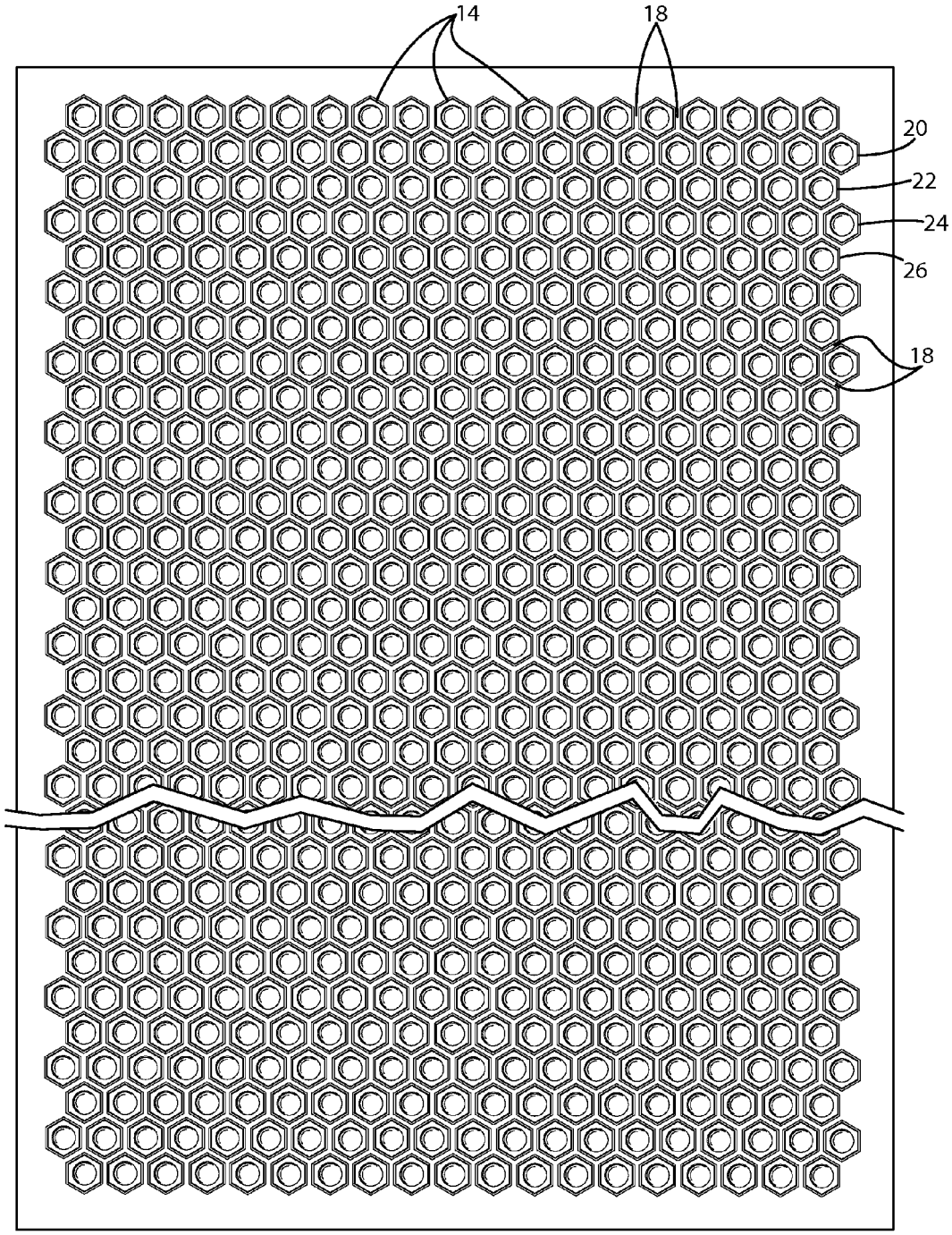
FIG. 5 is a side view of the impact absorbing material.

In the illustrated embodiment, there are spaces or grooves or gaps 18 between the hexagonal projections 14 on the first sheet 12. To reduce or eliminate any generally straight, elongated or continuous gaps 18, so as to reduce the risk that an object striking the wearer will align with a linear gap 18, each projection 14 is offset from the projections above and below the particular projection 14. In the illustrated embodiment, the projections 14 are arranged in a diagonal pattern. Specifically, the projections 14 are arranged in rows that are horizontally and vertically offset from the rows immediately above and below them. For example, as shown in FIG. 5, the projections 14 in row 22 are both horizontally and vertically offset from the projections 14 in rows 20 and 24, and the projections 14 in row 24 are horizontally and vertically offset from the projections 14 in rows 22 and 26, and so forth. However, the projections 14 may be arranged in any pattern designed to avoid linear gaps or grooves between the projections 14. For example, in alternative embodiments, the projections 14 may be arranged in circular patterns or wave-like patterns, in which each projection 14 is horizontally and/or vertically offset from immediately adjacent projections. As defined in this application, the term "gap" means that the adjacent projections are not connected to each other, such that some space can be formed between adjacent projections, the space may exist when the first sheet 12 is generally flat (as illustrated) or it may exist only when the first sheet 12 is flexed to separate the projections 14.

In the illustrated embodiment, the diagonal pattern of hexagonal projections 14 results in a hexagonal shaped groove or gap 18 positioned around each projection 14 between that projection and its immediately adjacent projections 14. Put another way, each pair of adjacent projections 14 defines a gap 18 therebetween. As shown in FIG. 5, the gaps 18 between the horizontal rows of projections are formed in a series of relatively short diagonal or angled segments, i.e. in a "zigzag" pattern. The gaps 18 between the vertical columns of projections 14 are also formed in short segments, which are angled about the projections 14. The gap 18 defined between any one of the projections 14 and a projection 14 adjacent to that one projection 14 is not linearly aligned with any of the gaps 18 defined between that one projection and any other projection adjacent to that projection 14. Thus, there are no continuous or elongated linear gaps 18, along which a generally straight object could be aligned when striking the wearer.

Figure 3:
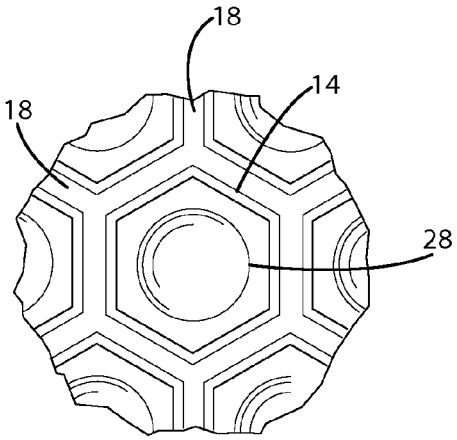
FIG. 3 is an expanded side view of the impact absorbing material.

To further direct impact forces away from any gaps 18, in the illustrated embodiment, each of the projections 14 includes an indentation 28 (FIGS. 3 and 4). The indentation 28 may be rounded or cup-shaped, as shown in the illustrated embodiment, or may be flat or angled to a point or line in the projection 14. The indentation 28 is positioned on an outer surface of the projection 14, such that a sharp or narrow object striking the wearer may be directed into the projection 14, as opposed to the gaps 18. In the illustrated embodiment, the indentations 28 are centered on the outer surface of the projections 14, which may assist in evenly dispersing forces across the projections 14.

The first and second sheets 12, 16 may be formed from any suitable materials, including polymeric materials such as natural or synthetic rubber. The first sheet 12, including the projections 14, may have a durometer in the range of 80 to 85 on the Asker Type A scale. To effectively absorb the impact forces from the projections 14, yet also provide flexibility, the second sheet 16 may have a durometer in the range of 50 to 55 on the Asker Type A scale. The first sheet 12 may also have a higher density than the second sheet 16.

The first and second sheets 12, 16 of the impact absorbing material 10 may be connected or bonded in any manner to sufficiently retain the sheets together such that the second sheet substantially continuously engages the first sheet. For example, the second sheet 16 may be bonded to the bottom surface 13 of the first sheet 12 by compression molding, in which the generally preheated molding material is placed in an open, heated mold cavity. The mold is closed and pressure is applied to force the material into contact with all mold areas, and heat and pressure are maintained until the molding material has cured to form the impact absorbing material 10.

The impact absorbing material 10 may be included or positioned throughout a footwear article or may be selectively positioned in predetermined locations on the footwear article. For example, the impact absorbing material 10 may be positioned to achieve protection in certain areas that are more likely to be subjected to impacts from external objects, or in areas that cover particularly vulnerable areas of the wearer's foot, such as the ankle area and area above the heel. In the illustrated embodiment of FIGS. 1 and 2, the impact absorbing material 10 is included in three sections of the boot 8: the lateral section 36, the heel section 38 and the medial section (not shown), which generally mirrors the shape of the lateral section on the other side of the boot 8. The placement of the impact absorbing material 10 in these sections helps to protect the vulnerable ankle and heel area.

In some embodiments, the footwear article may include additional reinforcements, such as, for example, a steel toe reinforcement. In such an embodiment, the impact absorbing material 10 may not need to be included in the reinforced area.

The impact absorbing material 10 can be inserted or incorporated into or attached to a footwear article in any suitable manner. In the illustrated embodiment of FIGS. 1 and 2, the impact absorbing material 10 is positioned in the boot 8 between an upper 30 and a liner 32 (see FIG. 4). Specifically, the boot 8 includes openings or pockets 40 between the upper 30 and the liner 32, in which the impact absorbing material 10 is positioned or contained. The pockets 40 in the boot 8 are located at the lateral section 36, the heel section 38 and the medial section, such that impact material can be positioned in these areas, as discussed above. In the sectional view of the lateral pocket 40 in FIG. 4, gaps or spaces are shown between the upper layers 30, 31 and the projections 14 of the impact absorbing material 10, and also between the second sheet 16 of the impact absorbing material 10 and the foam layer 33. However, these spaces are not required and are included for illustrative purposes.

To secure the impact absorbing material in position in the pockets 40, the impact absorbing material 10 may optionally be glued or stitched or otherwise attached to either the upper 30 or the liner 32. The pockets 40 may optionally be closed at or near the edges of the impact absorbing material 10, such as by stitching or glue or other suitable closure, to completely contain the impact absorbing material within the boot 8.

Figure 6:
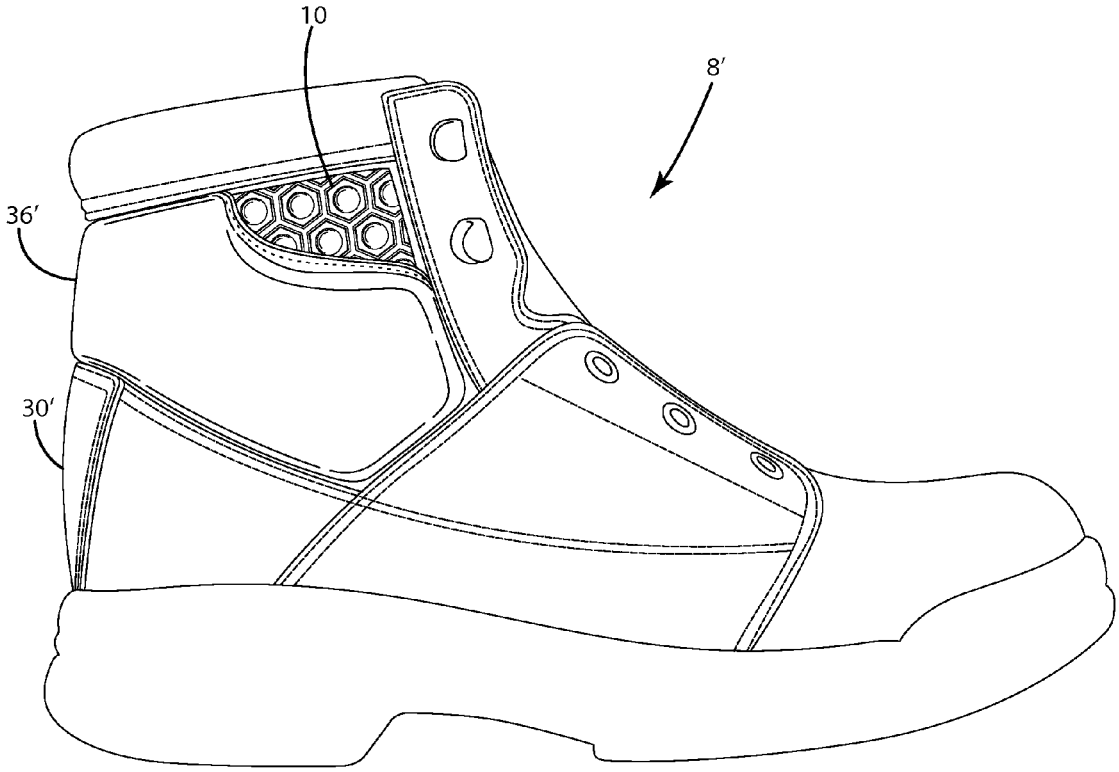
FIG. 6 is a side view of another boot with the impact absorbing material exposed.

In an alternative embodiment, the impact absorbing material 10 is included continuously around the lateral, heel and medial sections of a footwear article, as opposed to being included in separate sections. As shown in FIG. 6, one continuous piece or segment of impact absorbing material 10 is wrapped around the lateral, heel and medial sections of the boot 8' in one continuous section 36'. In this configuration, there are no gaps or spaces between separate sections or segments of impact absorbing material.

In the illustrated embodiment of FIG. 6, the impact absorbing material is positioned in the boot 8' between the upper 30' and an inner liner, as discussed above with respect to boot 8. However, in this embodiment, the impact absorbing material 10 is positioned in a single opening or pocket 40 between the upper 30' and the inner liner. The boot 8' of this embodiment may otherwise be similar to the boot 8 described above in the previous embodiment.

The design and configuration of the upper 30 and liner 32 of the boot 8 may vary from application to application. Because the impact absorbing material 10 provides a rigidity to the boot 8, the upper 30 and liner 32 may be manufactured from any desirable material, for example, leather, mesh, canvas, nylon, polymeric materials, rubber or the like. Optionally, the upper 30 and liner 32 may include multiple layers of materials. For example, as shown in the illustrated embodiment of FIG. 4, the upper 30 includes an additional layer 31.

Optionally, to provide additional cushioning in the boot 8, a layer of foam 33 may be included between the impact absorbing material 10 and the liner 32. In this embodiment, a back surface of the impact absorbing material 10 may be adhered or glued to the foam layer 33 to help maintain the position of the impact absorbing material 10 and/or the foam 33. To further assist in maintaining the position of the layers of the boot 8, a back surface of the foam layer 33 may be adhered or stitched or otherwise attached to the liner 32.

Figure 1:
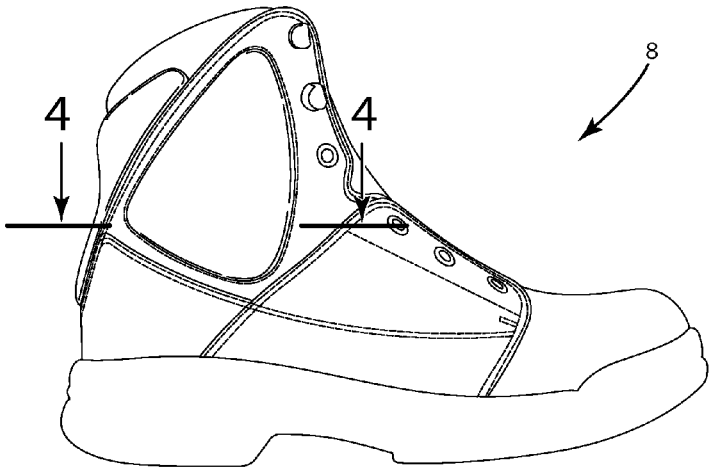
FIG. 1 is a side view of a boot having impact absorbing material in accordance with the present invention.

The boot 8 can otherwise be manufactured using generally conventional techniques and apparatus. As shown in FIGS. 1 and 2, the boot 8 also includes a midsole 34 and an outsole 36. The outsole 36 can be injection molded or pour molded from a hard, durable material, such as rubber, using conventional molding apparatus and techniques. The outsole and its components can be secured to the midsole with cement, adhesives or other attachment devices. The outsole components can be trimmed as desired to ensure a clean and flush fit with the upper and/or midsole as well. In another step, the upper 30 is joined with the midsole 34 and/or outsole 36. This can be accomplished by adhering these components together.

Once assembled, a number of conventional finishing operations can be performed on the boot 8. For example, the edges of the midsole 34 and outsole 36 can be trimmed and shaped; the upper 30 can be cleaned of any excessive adhesive, polished and treated as appropriate, and where applicable, laces can be inserted into eyelets.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are as follows:

1. A footwear article, comprising:

an upper;

a liner;

an outsole;

a layer of impact absorbing material selectively positioned between said upper and said liner, wherein said impact absorbing material includes a first sheet having a top surface facing toward the upper and a bottom surface facing away from the upper, the first sheet having a plurality of projections extending outward from the top surface, wherein said projections are shaped and positioned to disperse force from an impact, wherein said projections define gaps between adjacent pairs of said projections, each of said gaps being linearly offset from any said gaps adjacent thereto;

wherein said impact absorbing material includes a second sheet bonded to the bottom surface of said first sheet for absorbing said force from said projections, said second sheet having a lower durometer than said first sheet, said second sheet substantially continuously engaging said first sheet; and wherein each of said projections has an outer surface facing towards the upper and includes an indentation positioned on the outer surface.

2. The footwear article of claim 1, wherein said impact absorbing material is selectively positioned on said footwear article in at least one area that is predetermined to be vulnerable to receive said impact.

3. The footwear article of claim 2, wherein said impact absorbing material is positioned in at least one of a medial section, a lateral section and a heel section of said footwear article.

4. The footwear article of claim 2, wherein each of said projections is hexagonal in shape.

5. The footwear article of claim 2, wherein said first sheet has a durometer in the range of 80 to 85 on the Asker Type A scale.

6. The footwear article of claim 5, wherein said second sheet has a durometer in the range of 50 to 55 on the Asker Type A scale.

7. The footwear article of claim 6, wherein said footwear article is a boot.

* * * * *